US006119785A

United States Patent [19]

Reise et al.

[11] Patent Number: 6,119,785

[45] Date of Patent: Sep. 19, 2000

[54] FIRE-EXTINGUISHING DEVICE AND VALVE UNIT THEREFOR

[75] Inventors: Wulf Reise, Alfeld; Wilfried Henze, Deensen, both of Germany

[73] Assignee: Fagus-GreCon Greten BmbH & Co. KG, Deutschland, Germany

[21] Appl. No.: 09/043,335

[22] PCT Filed: Jul. 17, 1997

[86] PCT No.: PCT/EP97/03823

§ 371 Date: Jun. 15, 1998

§ 102(e) Date: Jun. 15, 1998

[87] PCT Pub. No.: WO98/03227

PCT Pub. Date: Jan. 29, 1998

[30] Foreign Application Priority Data

Jul. 17, 1996 [DE] Germany ..... 296 12 431

[51] Int. Cl.[7] ..... A62C 37/08

[52] U.S. Cl. ..... 169/56; 169/5; 169/9; 169/16

[58] Field of Search ..... 169/5, 9, 15, 14, 169/16, 56, 60, 61

[56] References Cited

U.S. PATENT DOCUMENTS

| | | | |
|---|---|---|---|
| 3,548,949 | 12/1970 | Williams | 169/9 X |
| 3,614,987 | 10/1971 | Bonne et al. | 169/60 |
| 3,671,208 | 6/1972 | Medsker | 169/15 X |
| 3,714,988 | 2/1973 | Livingston | 169/15 X |
| 4,722,358 | 2/1988 | Christensen | 169/15 X |
| 4,855,718 | 8/1989 | Cholin | 340/578 |
| 4,889,189 | 12/1989 | Roznieck | 169/73 |
| 4,993,495 | 2/1991 | Burcgert | 169/15 X |
| 5,193,622 | 3/1993 | Tibbling | 169/60 X |
| 5,740,867 | 4/1998 | Jansson | 169/61 X |
| 5,749,420 | 5/1998 | Jansson | 169/61 X |

FOREIGN PATENT DOCUMENTS

| | | | |
|---|---|---|---|
| 79819 | 9/1955 | Denmark | 169/5 |
| 477003 | 3/1997 | European Pat. Off. . | |
| 2916086 | 10/1987 | Germany . | |
| 4036041 | 8/1991 | Germany . | |
| 8703210 | 6/1987 | WIPO . | |
| 9417857 | 8/1994 | WIPO . | |

OTHER PUBLICATIONS

GreCon Funkenloschanlagen (No Date Available).
Total Sicherheit und Feuerschutz (No Date Available).

*Primary Examiner*—Lesley D. Morris
*Attorney, Agent, or Firm*—Robert L. Marsh

[57] ABSTRACT

The invention relates to a fire-extinguishing device and a valve block for a fire-extinguishing device. In order to create a fire-extinguishing device which has a short reaction time up to the quenching of sparks, there is provided, in a fire-extinguishing device which has an extinguishant pipe (14) which leads from an extinguishant reservoir to at least one quenching site and there terminates in an extinguishant outlet nozzle (16), an extinguishant container (20) in the region of the extinguishant outlet nozzle (16). From the container extinguishant flows into the extinguishant pipe upon a pressure drop in the extinguishant pipe (14). A valve block proposed according to the invention for a fire-extinguishing device facilitates the fitting of such an extinguishant container.

14 Claims, 3 Drawing Sheets

FIRE-EXTINGUISHING DEVICE AND VALVE UNIT THEREFOR

The invention relates to a fire-extinguishing device and to a valve block for a fire-extinguishing device.

BACKGROUND OF THE INVENTION

Practical examples of fire-extinguishing devices are known which are designed as spark-extinguishing systems for pipes which carry dust-laden gases. With these fire-extinguishing devices, pipes, which can have branches, run from a respective extinguishant reservoir each to at least one fire-extinguishing site. At the fire-extinguishing sites are located extinguishant nozzles which are fed from the extinguishant pipe and produce a fine spray in order to extinguish sparks.

In order to be able to achieve a desired extinguishing of sparks, the supply of extinguishant, particularly the supply of extinguishing water, is controlled by magnetic valves. The magnetic valves are connected to a control device in which signals supplied by spark detectors are evaluated and control signals for the magnetic valves are produced on the basis of the results of the evaluation.

The safety which is aimed for with such a fire-extinguishing device against dust explosions which can occur through unquenched sparks depends decisively not only upon the need for sparks which occur to be reliably detected, but also on the fact that after the detection of sparks an extinguishing of the sparks should follow immediately. It has been shown however that with the known fire-extinguishing devices noticeable time elapses between the first sensing of sparks and the complete formation of a spray.

It is an object of the invention to make available a fire-extinguishing device which has a short reaction time up to the triggering of the fire-extinguishing process.

SUMMARY OF THE INVENTION

According to the invention, in the case of a fire-extinguishing device having an extinguishant pipe and an extinguishant outlet nozzle, there is provided in the region of the extinguishant outlet nozzle an extinguishant container from which extinguishant flows into the extinguishant pipe in the event of a pressure drop in the extinguishant pipe. A pressure drop which prevents a fully effective formation of a spray occurs particularly if at the beginning of the extinguishing process extinguishant exits from the extinguishant outlet nozzle without sufficient extinguishant following it through the extinguishant pipe. This phenomenon, caused by the inertia of the extinguishant in the extinguishant pipe, is compensated so that extinguishant is supplied from the extinguishant container in the region of the extinguishant outlet nozzle, so that the time between the first ejection of extinguishant from the extinguishant outlet nozzle and the complete formation of a spray is considerably shortened. By the supply of extinguishant provided in the extinguishant container decentralized from the extinguishant reservoir, the reaction time of the fire-extinguishing device is now independent of the length of the extinguishant pipe and of its cross-section.

Preferably, the extinguishant container is formed as an expansion tank. In this way it is possible to fill the extinguishant container afresh by way of the extinguishant pipe after the termination of an extinguishing process, so that one can avoid the need for separate filling pipes and for additional operating procedures arising from the refilling. The extinguishant container is filled simply with the extinguishant transported by way of the extinguishant pipe, as soon as the pressure in the extinguishant pipe 14 is sufficient, and then compensates for an extinguishant demand at the beginning of a new extinguishing process.

A particularly simply embodiment of extinguishant container is produced if the compensating container comprises a pressure reservoir. This pressure reservoir, which preferably comprises a pressurized gas-filled cell with a flexible membrane, enables one to achieve, with little technical difficulty, a particularly reliable availability of extinguishant which can be supplied without great expense in terms of apparatus. By means of the pressure reservoir the extinguishant is made available immediately without any installations or devices having to be activated beforehand. Since the energy stored in the pressure reservoir for the supply of extinguishant can always be regenerated again by way of the extinguishant pipe, the fire-extinguishing device is above all very maintenance free and is suitable for a plurality of recurring extinguishing events.

The extinguishant container can be formed as a through-way container. Such a design is preferable from the point of view of flow technology, since in this way the extinguishant can be fed both from the through-way container and also from the extinguishant pipe without redirection through hoops, curves or T-pieces of the valve arrangement.

A shortening of the reaction time can be achieved also by the direct fitting of the extinguishant outlet nozzle to the valve arrangement or by an integration of the extinguishant outlet nozzle into the valve arrangement. This measure is particularly advantageous if also the extinguishant container is connected directly to the valve arrangement. By minimizing the conduit path, together with the ready availability of extinguishant close to the extinguishing site, a particularly short reaction time is achieved.

The fire-extinguishing device can be designed in the manner of a sprinkler system with extinguishant outlet nozzles which react to heat or pressure and are designed only for onetime use. Preferably, the fire-extinguishing device is designed however as a spark-extinguishing installation for pipes or containers carrying dust-laden gas and is provided with valve arrangements which are arranged in the region of the individual extinguishant outlet nozzles and control the passage of extinguishant from the extinguishant outlet nozzles. If these valve arrangements are remotely controlled, then one can achieve an extremely short reaction time in cooperation with spark detectors and a control unit. This applies particularly if the valve arrangements are magnetic valve arrangements.

Further advantageous features and embodiments of the invention are set out in the subsidiary claims as well as in the following description which is given with reference to the drawings.

DETAILED DESCRIPTION OF PREFERRED EMBODIMENTS

Figure 1:
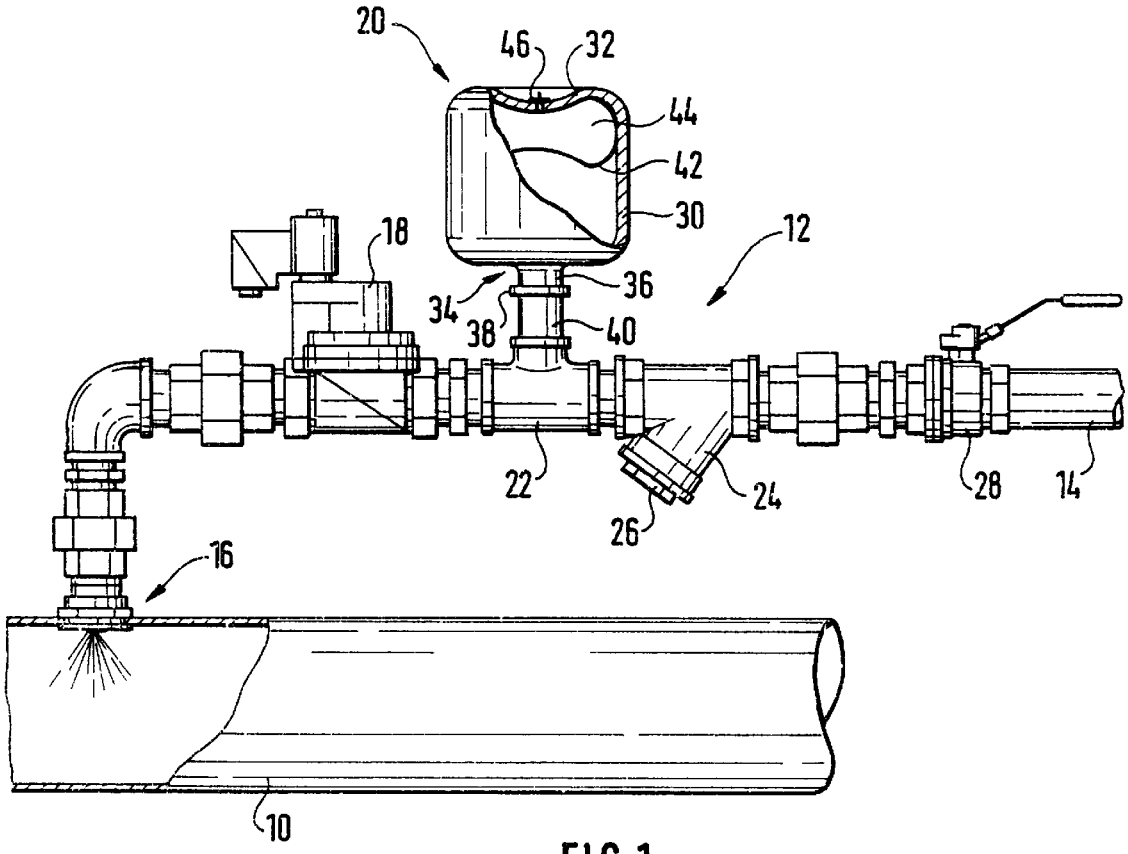
FIG. 1 is a section of a particularly preferred first embodiment of a fire-extinguishing device in accordance with the invention, which is designed as a spark-extinguishing installation.

In order to carry quenching water from an extinguishant reservoir which is not shown to a pipe 10 carrying dust-laden gas, the fire-extinguishing device 12 according to the first embodiment comprises an extinguishant pipe 14 which terminates in an extinguishant outlet nozzle 16. Upstream from the extinguishant outlet nozzle 16 is a magnetic valve 18 which acts as an extinguishing water valve and which is controlled via a not shown pipe connection by a control device (not shown) which is connected to spark detectors. The fire-extinguishing device 12 comprises, upstream from each magnetic valve 18, an extinguishant container 20 which is connected by means of a T-piece 22 to the extinguishant pipe 14.

In order to prevent blockages of the extinguishant outlet nozzle 16 and any contamination of the extinguishant container 20, upstream from the T-piece 22, in the extinguishant pipe 14, there is provided a dirt trap 24 which includes a mesh element which can be cleaned by means of an inspection hole which is closable by a cap 26. A shut-off member 28 arranged upstream from the dirt trap 24 and formed as a ball valve enables one to carry out servicing work on the dirt trap 24, the extinguishant container 20, the magnetic valve 18 or the extinguishant outlet nozzle 16 without having to put the whole fire-extinguishing device 12 out of service.

The extinguishant container 20 provided in the fire-extinguishing device 12 includes a sleeve 30 of deep-drawn steel sheet with a base 32 formed in one piece therewith. At the side of the extinguishant container 20 which lies opposite the base 22 there is provided a cover 34 which is releasably connected to the sleeve 30 and is connected by means of a neck 36 to a connecting flange 38. The extinguishant container 20 is connected to the T-piece 22 by means of the connecting flange 38 and a connecting pipe 40.

Within the interior of the extinguishant container 20 is provided a flexible bag 42 which is resistant to compression and which consists of rubber-like material. The bag is filled with a pressurized gas 44 and forms a pressurized gas store. The pressurized gas 44 is preferably air, which can be supplied by way of a valve 46, the valve extending through the base 32 of the extinguishant container 20. The bag 42 is in contact within the extinguishant container 20 with regions of its internal walls and acts directly on the extinguishant water, to the extent that this is present in the fire-extinguishing device 12. The length of the extinguishant pipe 14 carrying extinguishing water amounts in practice as a rule to more than 50 meters. If one assumes a pipe diameter of 50 mm (2 inches) and the usual pipe roughness as well as pipe guides one is talking in the case of fire-extinguishing devices according to the prior art of it taking about 160 ms to achieve a flow pressure of 6 bar at the extinguishant outlet nozzle.

In the operation of the fire-extinguishing device 12 in accordance with the invention however, extinguishing water is initially present in the extinguishant pipe 14 as far as the magnetic valve 18. Since the bag 42, before the charging of the fire-extinguishing device 12 with extinguishing water, has been pumped up to a pressure ot about 4 bar, extinguishing water by compression of the bag 42 fills the majority of the extinguishant container 20 until the pipe pressure is present in the bag 42.

If sparks have been detected by a spark detector, the magnetic valve 18 opens as a result of the signal supplied by the control unit. The reaction time up to the opening of the magnetic valve depends solely upon the processing speed of the electronics and the efficiency of the magnetic valve.

When the magnetic valve 18 is opened, initially the pressure in the extinguishant pipe 14 drops, since extinguishant water flows into the region between the extinguishant outlet nozzle 16 and the magnetic valve 18. The pipe pressure of about 7 bar which is impressed by the extinguishant reservoir, which is preferably a pressure increasing installation, is not initially available at the extinguishant outlet nozzle 16, since first of all the extinguishing water located in the extinguishant pipe 14 must be accelerated. Until the extinguishing water made available by the extinguishant reservoir has achieved the necessary flow speed and the necessary pressure in the region of the T-piece 22, extinguishing water flows, because of the effect of the pressurized gas 44 in the bag 42, through the T-piece 22 into the extinguishant pipe. Since only a small amount of water, preferably only 2 or 3 liters, has to be accelerated by the pressurized gas 44 in the bag 42, extinguishing water reaches the extinguishant outlet nozzle 16 under the pressure supplied by the bag 42 just a short time after the opening of the magnetic valve 18. By the provision of the extinguishant container 20, one in this way considerably reduces the time which is needed for the achievement of an effective extinguishing water pressure after the opening of the valve By experiment, the time can be considerably reduced.

By means of this reduced reaction time, it is possible to position the extinguishant outlet nozzle 16 very close to a spark detector, so that the time during which the spark remains unquenched in the pipe carrying the dust-laden gas and also the path can be considerably shortened. By the provision of a comparatively inexpensive extinguishant container 20, the efficiency of the fire-extinguishing device 12 can be considerably increased and consequently the safety for personnel and plant can be perceptibly improved.

Figure 2:
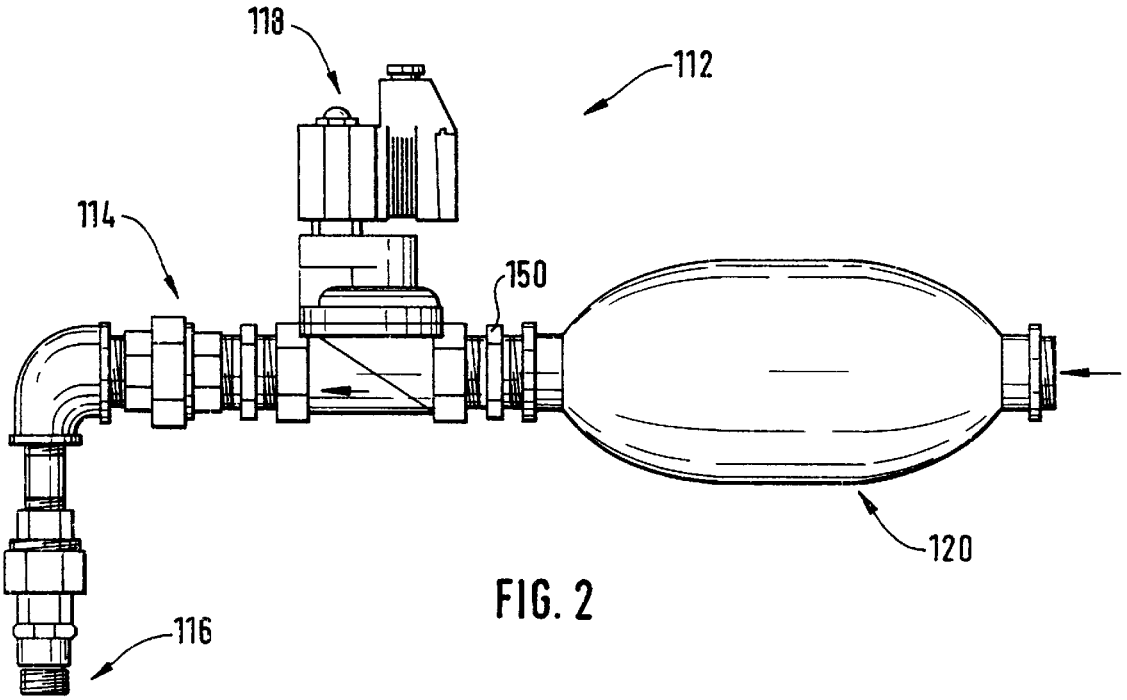
FIG. 2 is a section through a second embodiment of fire-extinguishing device in accordance with the invention.
Figure 3:
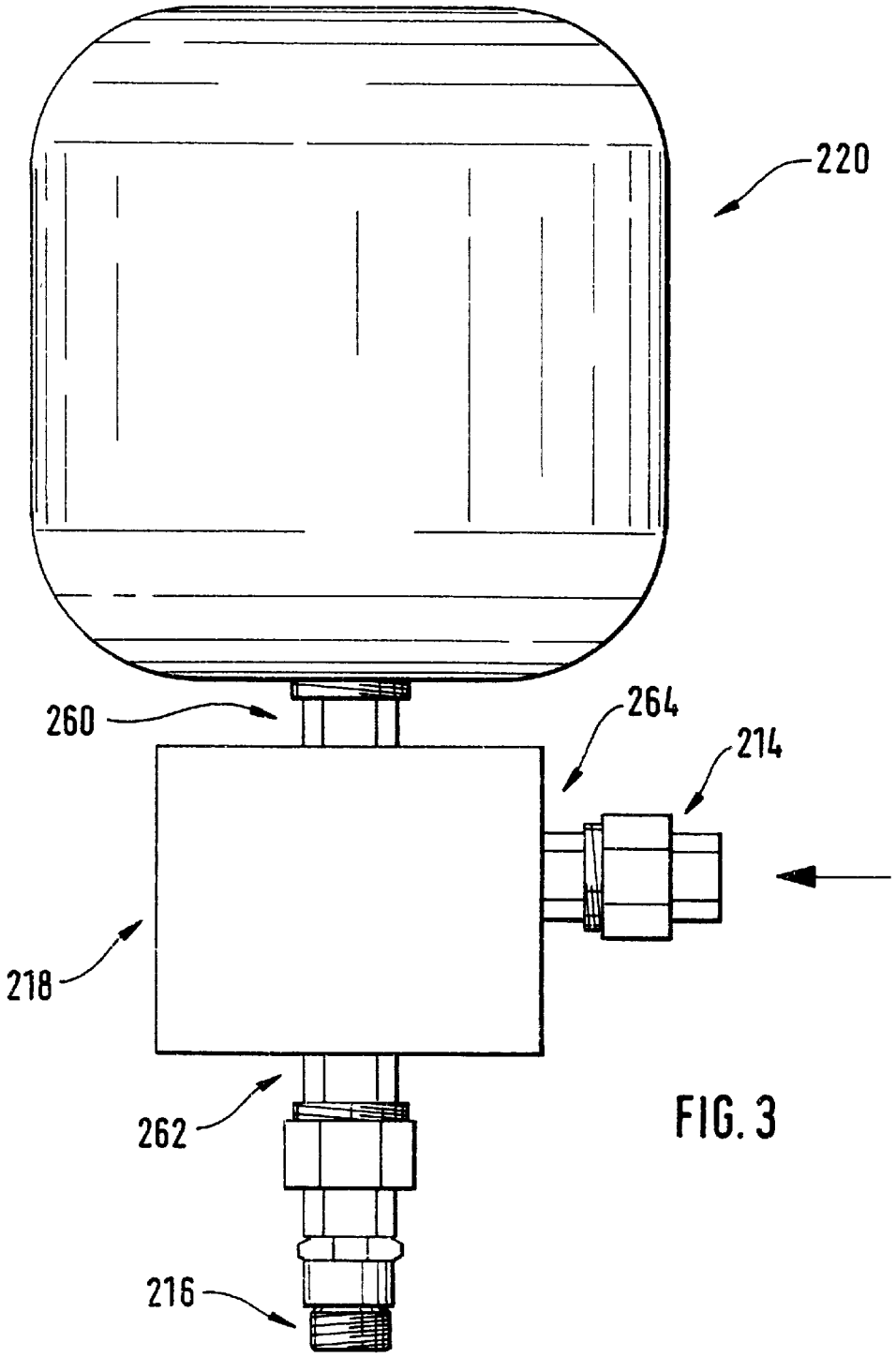
FIG. 3 is a section through a third embodiment of a fire-extinguishing device in accordance with the invention.

The section shown in FIG. 2 relates to a fire-extinguishing device 112 which differs from the fire-extinguishing device 12 according to the first embodiment only in respect of the extinguishant container 120. Those elements which correspond to elements shown in the first embodiment are provided here with reference numerals which have been increased by 100. Unless it is stated otherwise, the construction of the parts of the second embodiment corresponds to the construction of the parts of the first embodiment. Reference should he made to the corresponding description.

In contrast to the extinguishant container 20 of the first embodiment, the extinguishant container 120 of the second embodiment is formed as a through-way container and is built directly into the extinguishant pipe 114 without any T-piece, so that it can be traversed by the extinguishant. As in the case of the extinguishant container 20, with the extinguishant container 120 there is provided a bag which is resistant to compression for the availability of pressurized energy for the beginning of each quenching procedure. In order to maintain a short reaction time, the extinguishant container 120 is arranged in alignment with the through flow direction of the magnetic valve 118 and moreover is arranged immediately adjacent to the magnetic valve 118 by means of a double nipple 150 provided solely as an adaptor. It would be preferable for the magnetic valve 118 and the extinguishant container 120 itself to be connected without a double nipple.

The fire-extinguishing device of the third embodiment differs from the fire-extinguishing device of the first embodiment solely in respect of the design of the magnetic valve 218 and the arrangement of the extinguishant container 220. Parts which correspond to parts in the first embodiment are here provided with reference numerals which have been increased by 200 as compared with the reference numerals of the first embodiment. Reference is made to the corresponding description of the first embodiment and in particular to the fact that the internal construction of the extinguishant container 220 corresponds to that of the extinguishant container 20.

In contrast to the magnetic valves 18, 118, the magnetic valve 218 comprises a valve block with three terminals, with the terminal 260 for the extinguishant container 220 being arranged in alignment with the terminal 262 for the extinguishant outlet nozzle 216. The extinguishant outlet nozzle 216 is arranged directly on the magnetic valve 218, so that only small spaces have to be filled by the extinguishant before an effective spray is created after the beginning of the quenching process. A third terminal 264 serves for the connection to the extinguishant pipe 214.

What is claimed is:

1. A fire-extinguishing device comprising, an extinguishant pipe which leads from an extinguishant reservoir to at least one quenching site and there terminates at an extinguishant outlet nozzle, characterized in that in the region of the extinguishant outlet nozzle there is provided an extinguishant container from which extinguishant flows out into the extinguishant pipe upon a pressure drop in the extinguishant pipe, and the extinguishant container is formed as an expansion tank.

2. A fire-extinguishing device according to claim 1, characterized in that the extinguishant container comprises a pressure reservoir.

3. A fire-extinguishing device according to claim 2, characterized in that the extinguishant container is formed as a through-way container.

4. A fire-extinguishing device according to claim 3, characterized in that the extinguishant container is arranged directly on a valve unit arranged in advance of the extinguishant outlet nozzle.

5. A fire-extinguishing device according to clam 2, characterized in that the pressure reservoir comprises a membrane which is urged in the direction towards the extinguishant.

6. A fire-extinguishing device according to claim 5, characterized in that the membrane is urged by compressed air.

7. A fire-extinguishing device according to claim 2, characterized in that the extinguishant container is arranged directly on a valve unit arranged in advance of the extinguishant outlet nozzle.

8. A fire-extinguishing device according to claim 2, characterized in that the pressure reservoir comprises one of a cell and a bag filled with pressurized gas and is separated from the extinguishant by a flexible membrane.

9. A fire-extinguishing device according to claim 1 characterized in that the extinguishant container is formed as a through-way container.

10. A fire-extinguishing device according to claim 9, characterized in that the extinguishant container is arranged directly on a valve unit arranged in advance of the extinguishant outlet nozzle.

11. A fire-extinguishing device [according to claim 10,] comprising, an extinguishant pipe which leads from an extinguishant reservoir to at least one quenching site and there terminates at an extinguishant outlet nozzle, characterized in that in the region of the extinguishant outlet nozzle there is provided an extinguishant container from which extinguishant flows out into the extinguishant pipe upon a pressure drop in the extinguishant pipe, and the extinguishant container is formed as a through-way container.

12. A fire-extinguishing device according to claim 11, characterized in that the extinguishant container is arranged directly on a valve unit arranged in advance of the extinguishant outlet nozzle.

13. A valve block for a fire-extinguishing device having a first terminal for an extinguishant container, a second terminal for an extinguishant outlet nozzle and a third terminal for connection to an extinguishant pipe, wherein the first and the second terminal are arranged in alignment with one another.

14. A fire-extinguishing device comprising an extinguishant pipe providing an unobstructed path leading from an extinguishant reservoir to at least one quenching site terminating in an extinguishant outlet nozzle, an extinguishant container in communication with said extinguishant pipe from which an extinguishant will flow in the event of a pressure drop in said extinguishant pipe, said extinguishant container positioned in the region of said extinguishant outlet nozzle, and a valve unit at said quenching site between said extinguishant container and said outlet nozzle.

* * * * *

UNITED STATES PATENT AND TRADEMARK OFFICE

CERTIFICATE OF CORRECTION

PATENT NO. : 6,119,785

DATED : September 19, 2000

INVENTOR(S) : Wulf Reise and Wilfried Renze

It is certified that error appears in the above-indentified patent and that said Letters Patent is hereby corrected as shown below:

On the cover page, the name of the assignee, after "Greten" delete "GmbH" and substitute --GmbH--

In column 6, line 10, after "device" delete "[according to claim 10,]"

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*